US008136927B2

(12) United States Patent
Kondo et al.

(10) Patent No.: US 8,136,927 B2
(45) Date of Patent: Mar. 20, 2012

(54) LIQUID DROPLET DISCHARGE HEAD, LIQUID DROPLET DISCHARGE APPARATUS, AND METHOD FOR PRODUCING LIQUID DROPLET DISCHARGE HEAD

(75) Inventors: Hirofumi Kondo, Tajimi (JP); Koji Imai, Inuyama (JP); Toru Yamashita, Nagoya (JP); Masayoshi Hayashi, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 260 days.

(21) Appl. No.: 12/694,472

(22) Filed: Jan. 27, 2010

(65) Prior Publication Data

US 2010/0194826 A1 Aug. 5, 2010

(30) Foreign Application Priority Data

Jan. 31, 2009 (JP) ..... 2009-021036
Jan. 31, 2009 (JP) ..... 2009-021039

(51) Int. Cl.
*B41J 2/045* (2006.01)
*B41J 2/14* (2006.01)
*B41J 2/05* (2006.01)

(52) U.S. Cl. ..... 347/71; 347/50; 347/58

(58) Field of Classification Search ..... 347/72
See application file for complete search history.

(56) References Cited

U.S. PATENT DOCUMENTS

| | | | | |
|---|---|---|---|---|
| 2003/0156165 | A1 | 8/2003 | Sakaida | |
| 2005/0068375 | A1 | 3/2005 | Hibi et al. | |
| 2007/0222822 | A1 | 9/2007 | Ito | |
| 2008/0088672 | A1 | 4/2008 | Kobayashi | |
| 2008/0111859 | A1 | 5/2008 | Kondo | |
| 2009/0096844 | A1 * | 4/2009 | Kojima et al. | 347/72 |

FOREIGN PATENT DOCUMENTS

| | | |
|---|---|---|
| JP | 55-96697 | 7/1980 |
| JP | 2003-311954 | 11/2003 |
| JP | 2007-196404 | 8/2007 |
| JP | 2008-100377 | 5/2008 |
| JP | 2008-120023 | 5/2008 |

* cited by examiner

*Primary Examiner* — Matthew Luu
*Assistant Examiner* — Lisa M Solomon
(74) *Attorney, Agent, or Firm* — Frommer Lawrence & Haug LLP

(57) ABSTRACT

A piezoelectric actuator includes a first active portion interposed by an individual electrodes and a first constant electric potential electrode and a second active portion interposed by the individual electrode and a second constant electric potential electrode, and a wiring structure is provided with a wiring board and driver IC. The wiring board is provided with individual lines, a power line, a ground line, a first and second constant electric potential lines, a first short circuit line for short-circuiting the power line and the first constant electric potential line, and a second short circuit line for short-circuiting the ground line and the second constant electric potential line. Accordingly, a liquid droplet discharge head, which is capable of suppressing the crosstalk, is provided. The liquid droplet discharge head has the wiring structure suitable for the head.

16 Claims, 9 Drawing Sheets

LIQUID DROPLET DISCHARGE HEAD, LIQUID DROPLET DISCHARGE APPARATUS, AND METHOD FOR PRODUCING LIQUID DROPLET DISCHARGE HEAD

CROSS REFERENCE TO RELATED APPLICATION

The present application claims priority from Japanese Patent Application No. 2009-021036 filed on Jan. 31, 2009 and Japanese Patent Application No. 2009-021039 filed on Jan. 31, 2009, the disclosures of which are incorporated herein by reference in their entirety.

BACKGROUND OF THE INVENTION

1. Field of the Invention

The present invention relates to a liquid droplet discharge head provided with a piezoelectric actuator for discharging a liquid, a liquid droplet discharge apparatus including the same, and a method for producing the liquid droplet discharge head.

2. Description of the Related Art

An ink discharge head, which is carried on an ink-jet printer for recording an image on a recording medium, is known as an example of the liquid droplet discharge head. In order to obtain a high quality of the image to be recorded, it is required for the ink discharge head to increase the number of nozzles. In order to increase the number of nozzles, it is required to arrange pressure chambers provided corresponding to the respective nozzles at a high density. When the pressure chambers are arranged at a high density, the distance between the adjoining pressure chambers is shortened. Therefore, when the pressure is applied to the ink contained in the predetermined pressure chamber by driving the piezoelectric actuator, the influence, i.e., the so-called crosstalk arises, in which the adjoining pressure chamber is affected thereby. According to an ink discharge head described in Japanese Patent Application Laid-open No. 2003-311954, for example, individual electrodes are formed on one of the piezoelectric layers which is separated farthest from pressure chambers, and grooves are formed on the both sides of each of the individual electrodes. Therefore, the deformation of the area disposed between the pressure chambers can be absorbed by the grooves when the active portion is deformed in accordance with the piezoelectric effect.

When the grooves are formed on the both sides of each of the individual electrodes, then the deformation of the active portion is hardly transmitted or propagated to the adjoining pressure chamber as compared with a case in which the grooves are not formed, and it is possible to suppress the crosstalk. However, it is required that the pressure chambers should be also disposed at a higher density on account of the request for a higher quality. It is required to realize a more excellent countermeasure against the crosstalk.

SUMMARY OF THE INVENTION

In view of the above, an object of the present invention is to provide a liquid droplet discharge head in which the crosstalk can be satisfactorily suppressed even when pressure chambers are highly densified, the liquid droplet discharge head being provided with a wiring structure suitable for such a liquid droplet discharge head.

According to a first aspect of the present invention, there is provided a liquid droplet discharge head which discharges liquid droplets of a liquid onto a medium, the liquid droplet discharge head including:

a channel unit which is formed with a plurality of pressure chambers and a plurality of nozzles communicated with the pressure chambers, respectively;

a piezoelectric actuator which is arranged on the channel unit to cover the pressure chambers and which selectively applies a pressure to the liquid in the pressure chambers to discharge the liquid therefrom, the piezoelectric actuator including:

a piezoelectric layer which has first active portions corresponding to central portions of the pressure chambers and second active portions corresponding to portions surrounding the central portions of the pressure chambers;

a first constant electric potential electrode which is arranged on the first active portions;

a second constant electric potential electrode which is arranged on the second active portions; and individual electrodes which are arranged to face the first and second constant electric potential electrodes, the first active portions being arranged between the individual electrodes and the first constant electric potential electrodes, and the second active portions being arranged between the individual electrodes and the second constant electric potential electrodes; and a wiring structure which is connected to the piezoelectric actuator, the wiring structure including:

a wiring board;

a driver IC which is provided on the wiring board and which applies a driving electric potential to the individual electrodes; and lines which are provided on the wiring board, the lines including individual lines through each of which the driving electric potential from the driver IC is supplied to one of the individual electrodes, a power line through which an electric power is supplied to the driver IC, a ground line through which a ground electric potential is supplied to the driver IC, a first constant electric potential line through which a first constant electric potential is applied to the first constant electric potential electrode, a second constant electric potential line through which a second constant electric potential is applied to the second constant electric potential electrode, a first short circuit portion which short-circuits the power line and the first constant electric potential line, and a second short circuit portion which short-circuits the ground line and the second constant electric potential line, wherein the first and second active portions are deformed respectively so that the first and second active portions are elongated in a first direction directed toward the pressure chamber and the first and second active portions are shrunk in a second direction perpendicular to the first direction under a condition that the driving electric potential is applied to the individual electrodes; an electric field is not generated in the second active portion under a condition that an electric field is generated in the first active portion, and an electric field is not generated in the first active portion under a condition that an electric field is generated in the second active portion.

According to the liquid droplet discharge head, the deformation is caused in the opposite directions in accordance with the application/no application of the voltage in relation to the first active portion corresponding to the central portion of the pressure chamber and the second active portion corresponding to the portion disposed outside the central portion of the pressure chamber. Accordingly, when the deformation of the first active portion is transmitted or propagated to the adjoining pressure chamber, the transmission or propagation of the deformation is canceled by the deformation of the second active portion. Accordingly, even when the adjoining pressure chambers are disposed closely to one another by highly densifying the pressure chambers, then it is possible to avoid the transmission of the deformation of the first active portion to the adjoining pressure chamber, and it is possible to satisfactorily suppress the so-called crosstalk. When the liquid droplet discharge head is constructed as described above, the predetermined electric potentials can be applied to the three types of the electrodes respectively by means of the wiring structure. The piezoelectric actuator, which is provided with the two types of the active portions constructed by the three types of the electrodes, can be operated so that the crosstalk is suppressed as described above.

According to a second aspect of the present invention, there is provided an ink-jet printer which discharges the ink as the liquid to the medium, the ink-jet printer including:

the liquid droplet discharge head according to the first aspect;

an ink tank which supplies the ink to the liquid droplet discharge head; and a transport mechanism which transports the medium to an area facing the liquid droplet discharge head.

In this case, the ink-jet printer, which is capable of satisfactorily suppressing the crosstalk, can be provided even when the pressure chambers are highly densified. It is possible to provide the wiring structure suitable for the ink discharge head to be used for the ink-jet printer as described above.

According to a third aspect of the present invention, there is provided a method for producing the liquid droplet discharge head according to the first aspect, the method including:

polarizing the first active portion of the piezoelectric layer by applying a first voltage between the first constant electric potential electrode and each of the individual electrodes while the first constant electric potential electrode and the power line are electrically insulated;

polarizing the second active portion of the piezoelectric layer by applying a second voltage between the second constant electric potential electrode and each of the individual electrodes while the second constant electric potential electrode and the ground line are electrically insulated; and providing the first and second short circuit portions after polarizing the first and second active portions of the piezoelectric layer.

In this case, the first and second short circuit portions are not provided when the first and second active portions are polarized. Therefore, it is not feared that the high voltage, which is required when the first and second active portions are polarized, may be applied to the driver IC. It is possible to avoid the breakage of the driver IC.

DESCRIPTION OF THE PREFERRED EMBODIMENTS

Figure 9:
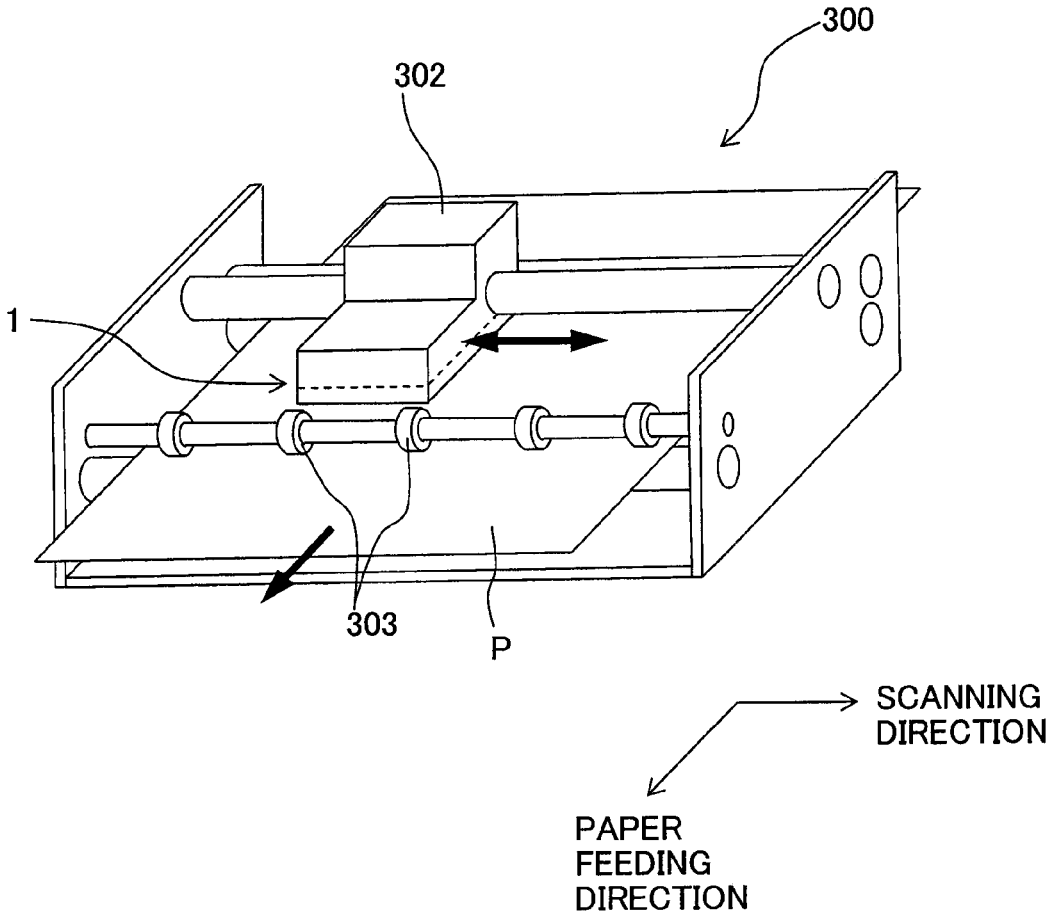
FIG. 9 schematically shows an ink-jet printer according to the embodiment.

An embodiment according to the present teaching will be explained with reference to the drawings. This description is illustrative of a case in which the liquid droplet discharge head according to the present teaching is applied to an ink discharge head carried on an ink-jet printer by way of example. This description will be made assuming that the direction, in which the ink is discharged from the head, is the downward direction. As shown in FIG. 9, the ink-jet printer 300 comprises, for example, a carriage 302 which is reciprocatively movable in the left-right direction (scanning direction) as viewed in FIG. 9, a serial type ink discharge head 1 which is provided on the carriage 302 and which discharges inks onto the recording paper P, and transport rollers (transport mechanism) 303 which transport the recording paper P in the frontward direction as viewed in FIG. 9. In the ink-jet printer 300, the ink discharge head 1 discharges the inks to the recording paper P from nozzles 4 (see FIG. 3) of the ink discharge head 1, while making the reciprocating movement in the scanning direction together with the carriage 302. For example, a desired image and letters are recorded on the recording paper P, and the recording paper P, on which the image or the like has been recorded, is discharged in the frontward direction by means of the transport rollers 303. The ink discharge head 1 is not limited to the serial type head, which may be a line type head.

Figure 1:
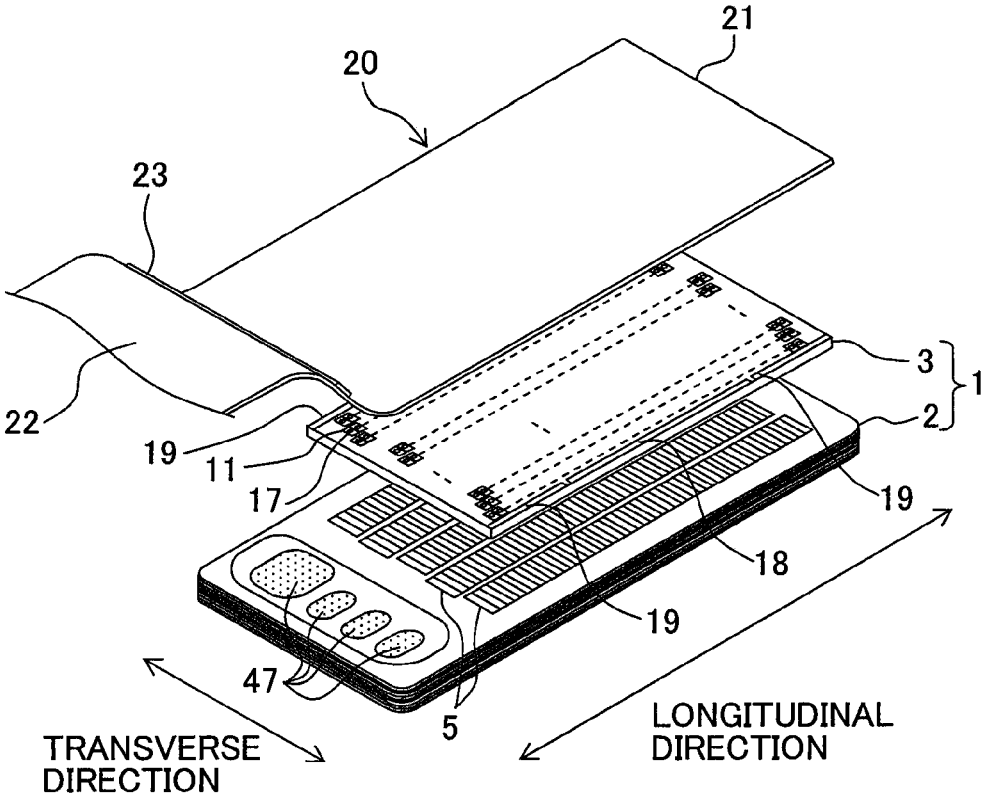
FIG. 1 shows an exploded perspective view illustrating an ink discharge head according to an embodiment of the present invention.
Figure 2:
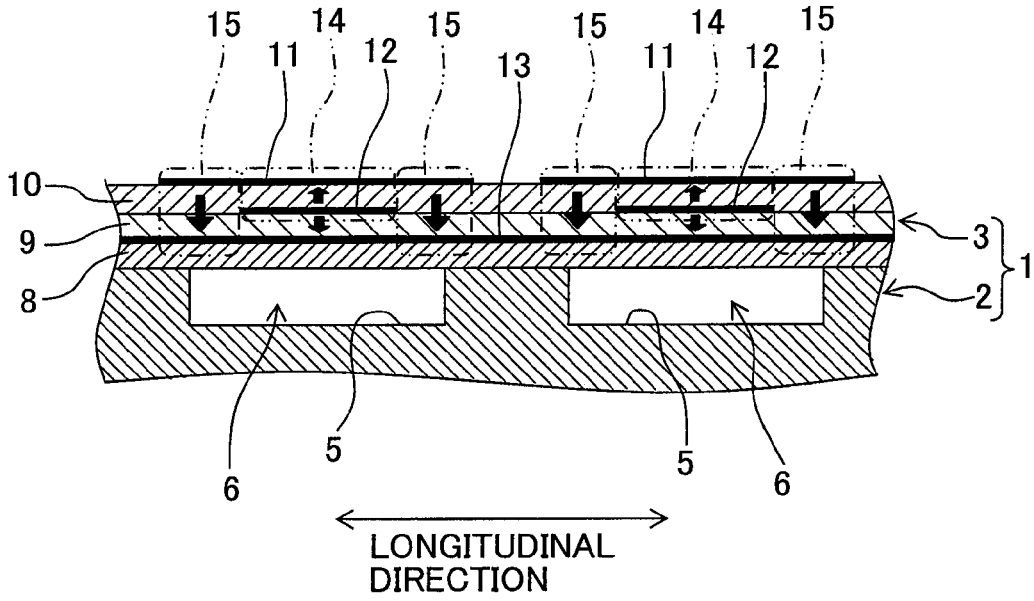
FIG. 2 shows a partial vertical sectional view illustrating the ink discharge head shown in FIG. 1.
Figure 3:
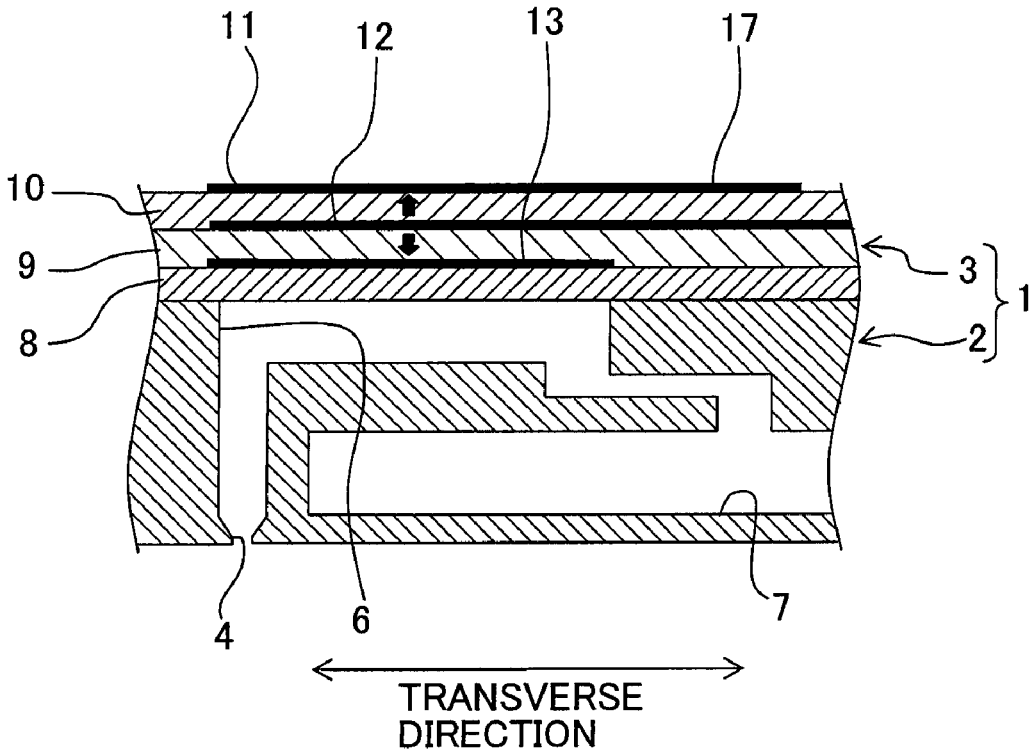
FIG. 3 shows a partial lateral sectional view illustrating the ink discharge head shown in FIG. 1.

As shown in FIGS. 1 to 3, the ink discharge head 1 is constructed by overlapping and joining a piezoelectric actuator 3 from the upper side of a channel unit 2. The channel unit 2 and the piezoelectric actuator 3 are substantially rectangular as viewed in a plan view. The long side direction thereof is conveniently designated as "vertical direction", and the short side direction is conveniently designated as "lateral direction".

As shown in FIG. 3, the nozzles 4 are open on the lower surface of the channel unit 2. Pressure chamber holes 5, which are communicated with the nozzles 4, are open on the upper surface. With reference to FIG. 1, the pressure chamber hole 5 is defined to have a substantially rectangular outer edge which is long in the lateral direction. A plurality of the pressure chamber holes 5 are disposed at a high density on the upper surface of the channel unit 2. The pressure chamber holes 5 are provided in parallel at substantially constant pitches in the vertical direction to form a plurality of pressure chamber arrays. The pressure chamber holes 5 are arranged in a staggered manner in the lateral direction. Each of the pressure chamber holes 5 is communicated with one nozzle 4 corresponding thereto. The plurality of nozzles 4 are disposed in the substantially same pattern as that of the pressure chamber holes 5 on the lower surface of the channel unit 2. As shown in FIG. 3, the pressure chamber holes 5 are closed by the lower surface of the piezoelectric actuator 3, and thus a plurality of pressure chambers 6 are formed in the ink discharge head 1. The channel unit 2 is formed with a plurality of common ink chambers 7 which are provided individually corresponding to the types of the inks respectively and each of which stores each of the inks supplied from external ink supply sources. Each of the pressure chambers 6 is communicated with one of the common ink chambers 7. As shown in FIG. 1, the channel unit 2 is formed with ink supply ports 47 for introducing the inks into the channel unit 2. Ink channels are formed in the channel unit 2 in order to supply the inks from the ink supply ports 47 via the common ink chambers 7 and the respective pressure chambers 6 to the respective nozzles 4.

As shown in FIGS. 2 and 3, the piezoelectric actuator 3 has a bottom layer 8 which serves as a vibration plate, and two piezoelectric layers which are stacked on the bottom layer 8. The piezoelectric layer, which is included in the two piezoelectric layers and which is disposed on the lower side, is referred to as "intermediate layer 9", and the piezoelectric layer, which is disposed on the upper side, is referred to as "top layer 10". The bottom layer 8 is formed of a piezoelectric material containing main components of lead titanate zirconate as the mixed crystal of lead titanate and lead zirconate. The bottom layer 8 is arranged on the upper surface of the channel unit 2 so that the plurality of pressure chambers 6 are covered therewith. The bottom layer 8 has a thickness of about 20 μm. The material of the bottom layer 8 is not limited to the piezoelectric material. The intermediate layer 9 and the top layer 10 are composed of the piezoelectric material which is the same as or equivalent to that of the bottom layer 8. The intermediate layer 9 and the top layer 10 are arranged on the upper surface of the bottom layer 8 while being stacked with each other. Each of the intermediate layer 9 and the top layer 10 also has a thickness of about 20 μm. Substantially rectangular individual electrodes 11, which correspond to the respective pressure chambers 6, are provided on the upper side of the top layer 10 so that the individual electrodes 11 are arranged to be opposed to the respective pressure chambers 6. Each of the individual electrodes covers the substantially entire region of one of the pressure chambers 6. Upper constant electric potential electrodes 12, which correspond to the respective pressure chambers 6, are provided between the intermediate layer 9 and the top layer 10. Lower constant electric potential electrodes 13, which are common to the plurality of pressure chambers 6, are provided between the bottom layer 8 and the intermediate layer 9.

As shown in FIG. 2, the center of each of the individual electrodes 11 and the center of one of the upper constant electric potential electrodes 12 are substantially coincident with each other in relation to the vertical direction. The size of the individual electrodes 11 in the vertical direction is longer than that of the upper constant electric potential electrodes 12. Therefore, as viewed in a plan view, the central portion in the vertical direction of each of the individual electrode 11 is overlapped with one of the upper constant electric potential electrode 12, and the both end portions in the vertical direction of each of the individual electrodes 11 are overlapped with one of the lower constant electric potential electrodes 13. The portions of the top layer 10, each of which is interposed between one of the central portion in the vertical direction of the individual electrodes 11 and one of the upper constant electric potential electrodes 12, forms a first active portion 14 which is polarized between the electrodes 11, 12. The portions, of the top layer 10 and the intermediate layer 9, each of which is interposed between the respective end portions in the vertical direction of one of the individual electrodes 11 and one of the lower constant electric potential electrodes 12, form second active portions 15 which are polarized between the electrodes 11, 13. In other words, the first active portions 14 are arranged corresponding to the central portions of the pressure chambers 6, and the second active portions 15 are arranged corresponding to the portions which are disposed outside the first active portions 14 and which are disposed outside the central portions of the pressure chambers 6.

As shown in FIGS. 1 and 3, each of the individual electrodes 11 has an extending portion which extends to protrude in the lateral direction to the area not opposed to the pressure chambers 6 from the end edge disposed on the side opposite to the nozzle 4 in relation to the lateral direction. A terminal portion 17 is integrally provided at the extending portion. The upper and lower constant electric potential electrodes 12, 13 (see FIGS. 2 and 3) are in electrical conduction with terminal portions 18, 19 provided on the upper surface of the top layer 10 via the conductive material charged into unillustrated through-holes respectively. A wiring board or plate 20 is provided in an overlapped manner on the upper surface side of the top layer 10. Connecting terminals, which correspond to the terminal portions 17 to 19, are provided on the lower surface side of the wiring board 20. The wiring board 20 is joined to the piezoelectric actuator 3 so that the connecting terminals are in electrical conduction with the corresponding terminal portions 17 to 19 respectively, for example, via unillustrated bumps composed of a conductive material such as metal or the like.

The electric potential, which is applied to each of the individual electrodes 11, can be switched between the high electric potential and the ground electric potential by means of a driver IC 23 mounted on the wiring board 20. Upon the driving in which the volume of the corresponding one of the pressure chambers 6 is varied, the high electric potential (hereinafter referred to as "first electric potential") of, for example, about 20 V is selectively applied to the one of the individual electrodes 1. The ground electric potential (hereinafter referred to as "second electric potential") is thereafter applied. On the other hand, during the waiting in which it is unnecessary to discharge the ink, the second electric potential is applied. The first electric potential is always applied to the upper constant electric potential electrodes 12 by the aid of the wiring board 20, and the second electric potential is always applied to the lower constant electric potential electrodes 13. Each of the first active portions 14 is previously polarized in the same direction as the direction of the electric field caused by the voltage applied during the waiting, and each of the second active portions 15 is previously polarized in the same direction as the direction of the electric field caused by the voltage applied during the driving. When the electric potential difference arises between the pair of electrodes which are arranged while interposing the active portions, then the voltage is applied to the piezoelectric layer interposed between the electrodes, and the electric field is generated in the stacking direction. The inverse piezoelectric effect is brought about when the direction of polarization of the piezoelectric layer is the same as the direction of the electric field. The piezoelectric layers 9, 10 are elongated or expanded in the stacking direction as the direction of polarization, and the piezoelectric layers 9, 10 are shrunk or contracted in the horizontal direction as the direction perpendicular to the stacking direction.

Therefore, the second active portions 15, to which the voltage to cause the inverse piezoelectric effect is not applied, are not deformed during the waiting, and the first active portions 14, to which the voltage to cause the inverse piezoelectric effect is applied, are elongated in the stacking direction and shrunk in the horizontal direction. In this situation, the difference arises in the strain in the horizontal direction between the top layer 10 and the intermediate layer 9, because the intermediate layer 9 is joined to the bottom layer 8. Accordingly, the bottom layer 8, the intermediate layer 9, and the top layer 10 are deformed to protrude in the stacking direction directed toward the pressure chambers 6. During the driving, the first active portions 14, to which the voltage to cause the inverse piezoelectric effect is not applied, are restored to the original state from the deformed state. On the other hand, the second active portions 15, to which the voltage to cause the inverse piezoelectric effect is applied, intend to be elongated in the stacking direction and shrunk in the horizontal direction. Therefore, the second active portions 15 are deformed so that the second active portions 15 are warped in the direction to make separation from the pressure chambers 6. The volume of the pressure chambers 6 are increased in accordance with the combination of the deformations of the active portions 14, 15. The ink is supplied from the common ink chamber 7 to the pressure chamber 6. When the electric potential of the individual electrodes 11 is the same as the electric potential of the lower constant electric potential electrode 13, then the bottom layer 8, the intermediate layer 9, and the top layer 10 are deformed to protrude in the stacking direction toward the pressure chambers 6 in the same manner as described above, and the volume of the pressure chambers 6 are instantaneously decreased. Accordingly, the ink, which is contained in the pressure chambers 6, are discharged downwardly from the nozzles 4.

In this way, the first active portions 14 are deformed by switching the application and no application of the voltage to the first active portions 14 in the ink discharge head 1. Simultaneously, the application and no application of the voltage are switched with respect to the second active portions 15. In accordance with this switching, the second active portions 15 are deformed to suppress the transmission or propagation of the deformation of the first active portions 14 to the adjoining pressure chambers 6. Therefore, even when the plurality of pressure chambers 6 are arranged at the high density, it is possible to satisfactorily suppress the crosstalk.

The arrangement of the piezoelectric actuator 3 of the liquid droplet discharge head 1 according to the present teaching is not limited to the above. The piezoelectric actuator may be constructed in any way provided that the piezoelectric actuator has two types of constant electric potential electrodes and one type of individual electrode with respect to each of the pressure chambers, and these three types of electrodes are used to form the first active portion corresponding to the central portion of the pressure chamber and the second active portions corresponding to the portions disposed outside the central portion. The second active portion 15 may include an area disposed inside the outer circumferential edge of the pressure chamber 6. Accordingly, not only the first active portion 14 but also the second active portion 15 contributes to the change of the volume of the pressure chambers 6. The volume of the pressure chamber 6 can be greatly varied as compared with a case in which only the first active portion 14 is used.

When the piezoelectric actuator 3 is produced, the bottom layer 8, the intermediate layer 9, the top layer 10, and the respective electrodes 11 to 13 are firstly stacked with each other so that the positional relationship is obtained as described above. Subsequently, the polarization step is performed to polarize the first and second active portions 14, 15 of the piezoelectric actuator 3. Accordingly, the piezoelectric actuator 3, which is capable of performing the operation to discharge the inks as described above, is prepared. Details of the polarization step will be described later on.

Subsequently, an explanation will be made with reference to FIGS. 1, 4, and 5 about the wiring structure to apply the voltage to the piezoelectric actuator 3. As shown in FIG. 4, this wiring structure is provided with the wiring board 20 as described above. The wiring board 20 includes rectangular COF 21 which is overlapped with the piezoelectric actuator 3 from the upper side and which is joined to the upper side of the piezoelectric actuator 3, and band-shaped FPC 22 which is joined to one end edge of COF 21. FPC 22 is provided so that FPC 22 is led to the outside from the piezoelectric actuator 3 in a state in which COF 21 is joined to the piezoelectric actuator 3. Each of COF 21 and FPC 22 is a known flexible wiring board or circuit board. FPC 22 is joined electrically and mechanically to COF 21, for example, by means of the soldering. As a result of the joining, the lines, which are provided for COF 21 and FPC 22, are in electrical conduction with each other. Contacts of the respective lines are provided for FPC 22 at the end edge disposed on the side opposite to the joining portion with respect to COF 21. The contacts may be connected to a receptacle connector mounted on the board arranged at a predetermined position of the ink-jet printer.

The driver IC 23, which selectively outputs the voltage to be applied to each of the individual electrodes 11, is mounted on COF 21 of the wiring board 20. A plurality of individual lines 24, power lines (VDD2) 25, ground lines (VSS2) 26, upper constant electric potential lines (VCOM) 27, lower constant electric potential lines (COM) 28, first short circuit lines 29, and second short circuit lines 30 are provided on the wiring board 20. Although not shown, other than the above, FPC 22 of the wiring board 20 is provided with, for example, a waveform signal line for transmitting the waveform signal for designating the driving mode of the piezoelectric actuator 3, a printing data line for transmitting the printing data for instructing, for each channel, the driving signal to be outputted from the driver IC 23 to the individual electrode 11, a plurality of control signal lines for outputting, for example, the clock signal, a power line (VDD1) for supplying the power-source voltage of the driver IC 23 (for example, 3.3 V), and a ground voltage line (VSS1) (for example, 0 V), and the lines are connected to the driver IC 23.

Each of the individual lines 24 is provided corresponding to each of the individual electrodes 11, which is a line to apply the first and second electric potentials to each of the individual electrodes 11 in accordance with the discharge timing of the ink. Each of the individual lines 24 extends from the driver IC 23 toward the connecting terminal on the wiring board 20 corresponding to each of the terminal portions 17 of each of the individual electrodes 11.

The power line (VDD2) 25 is a line to supply the electrical power to the driver IC 23, which is connected to the driver IC 23. The ground line (VSS2) 26 is a line to connect the driver IC 23 to the ground electric potential, which is connected to the driver IC 23.

The upper constant electric potential line (VCOM) 27 is a line to always apply the first electric potential as the high electric potential to the upper constant electric potential electrode 12, which extends toward the connecting terminal on the wiring board 20 corresponding to the terminal portion 18 of the upper constant electric potential electrode 12. The lower constant electric potential line (COM) 28 is a line to always apply the second electric potential as the ground electric potential to the lower constant electric potential electrode 13, which extends toward the connecting terminal on the wiring board 20 corresponding to the terminal portion 19 of the lower constant electric potential electrode 13.

The first short circuit line 29 is a line to connect the power line 25 and the upper constant electric potential line 27. The second short circuit line 30 is a line to connect the ground line 26 and the lower constant electric potential line 28.

Figure 5:
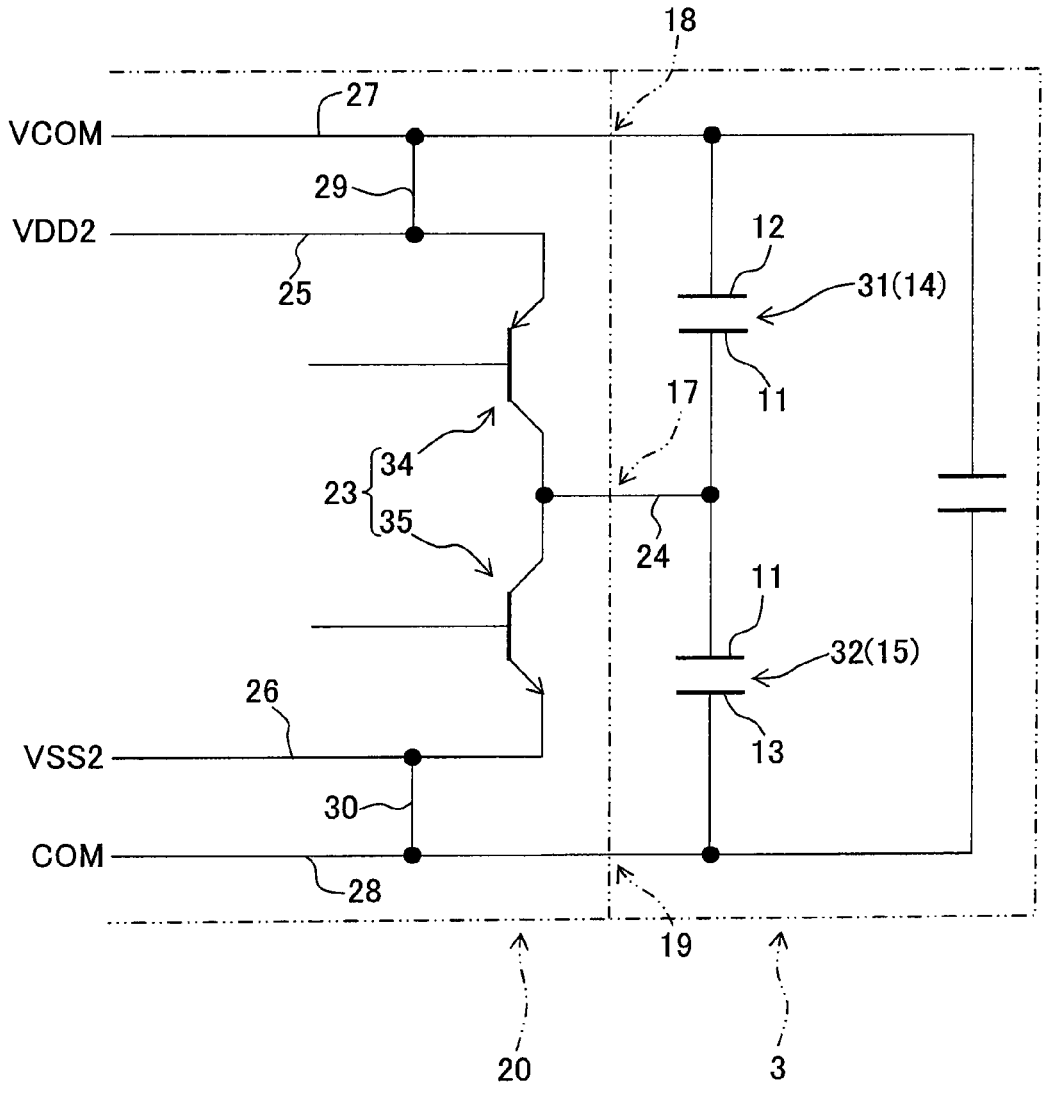
FIG. 5 shows an electric circuit diagram illustrating the electric arrangement of the wiring structure and an piezoelectric actuator shown in FIGS. 1 to 4.

As shown in FIG. 5, the first and second active portions 14, 15 are equivalent to first and second capacitors 31, 32 which use the respective electrodes 11 to 13 as parallel plate electrodes respectively. The upper constant electric potential line (VCOM) 27 and the lower constant electric potential line (COM) 28 are connected to one another via the capacitors 31, 32. The first capacitor 31 is positioned on the high electric potential side. During the charge of the capacitors 31, 32, the active portions 14, 15, which are equivalent thereto, are deformed. During the discharge of the capacitors 31, 32, the active portions 14, 15, which are equivalent thereto, are restored from the deformed state.

The driver IC 23 is equivalent to such a circuit that the states of the both capacitors 31, 32 are switched, while the charge/discharge state of the first capacitor 31 and the charge/discharge state of the second capacitor 32 are in a mutually opposite relationship. The circuit can be represented, for example, by two transistors 34, 35 which intervene in series between the power line (VDD2) 25 and the ground line (VSS2) 26. In other words, the power line 25 is connected to the collector of the first transistor 34, the emitter of the first transistor 34 is connected to the collector of the second transistor 35, and the emitter of the second transistor 35 is connected to the ground line 26. The individual line 24 connects the individual electrode 11 and the line which connects the both transistors 34, 35. The individual electrode 11 functions as an electrode of the low electric potential side of the first capacitor 31 which is equivalent to the first active portion 14. The individual electrode 11 also functions as an electrode of the high electric potential side of the second capacitor 32 which is equivalent to the second active portion 15.

As described above, when the ink is discharged, the following procedure is adopted. That is, the electric potential of the individual electrode 11 is allowed to rise from the second electric potential as the ground electric potential to the first electric potential as the high electric potential. After that, the electric potential of the individual electrode 11 is allowed to fall from the first electric potential to the second electric potential. During the waiting, the second electric potential is applied to the individual electrode 11.

The rising of the electric potential of the individual electrode 11 is equivalent to the fact that the first transistor 34 is turned ON and the second transistor 35 is turned OFF. In this situation, the power line 25 is connected to the lower constant electric potential line 28 via the first transistor 34 and the second capacitor 32, and the second capacitor 32 is charged. The falling of the electric potential of the individual electrode 11 is equivalent to the fact that the first transistor 34 is turned OFF and the second transistor 35 is turned ON. In this situation, the upper constant electric potential line 27 is connected to the ground line 26 via the first capacitor 34 and the second transistor 35, and the first capacitor 31 is charged. The second capacitor 32, which is charged during the rising, is disposed on the closed circuit constructed by the individual line 24, the ground line 26, the second short circuit line 30, and the lower constant electric potential line 28. The electric charge, which is stored in the second capacitor 32, is discharged. The ON/OFF setting of the respective transistors 34, 35 in this situation is also maintained during the waiting. Therefore, taking the rising of the electric potential of the individual electrode 11 into consideration again, the first capacitor 31, which is charged during the waiting, is disposed on the closed circuit constructed by the upper constant electric potential line 27, the first short circuit line 29, and the individual line 24. The electric charge, which is stored in the first capacitor 31, is discharged.

This wiring structure is provided with the two short circuit lines 29, 30 together with the individual line 24, the power line 25, the ground line 26, the upper constant electric potential line 27, and the lower constant electric potential line 28. Therefore, the first and/or second electric potential or electric potentials can be applied to the three types of electrodes 11 to 13. The two types of active portions 14, 15, which are constructed by the three types of electrodes 11 to 13, can be operated so that the crosstalk is suppressed.

However, the larger the line length to the first short circuit line 29 from the first capacitor 31 of the driver IC 23 and the line length to the second short circuit line 30 from the second capacitor 32 of the driver IC 23 are, the larger the line resistance is. Therefore, the voltage drop is consequently increased in the capacitors 31, 32. The maximum rated voltage, which can be applied to the driver IC 23, is determined. If any voltage, which is not less than the maximum rated voltage, is applied, it is feared that the driver IC 23 may be destroyed. The maximum rated voltage is principally determined on the basis of the high electric potential VDD2 (for example, 28 V) applied to drive the piezoelectric actuator 3. When the driver IC 23 is driven, unillustrated VDD1 (for example, 3.3 V), which is the driving voltage of the driver IC 23 itself, is applied. If the voltages VDD1, VDD2 are greatly varied when the driver IC 23 is driven, it is also feared that the driver IC 23 may be destroyed. If the short circuit line is provided on the board described above connected to the contact of FPC 22, the line resistance and the voltage drop are increased on the basis of the length of FPC 22. In other words, the voltage drop (for example, $\Delta V$) of the voltage inputted into the driver IC 23 is increased. Therefore, the amount $\Delta V$ corresponding to the voltage drop is further applied in addition to the voltage VDD2 applied to the driver IC 23. It is more sincerely feared that the driver IC 23 may be destroyed. Further, it is difficult to apply the desired second electric potential to the individual electrode 11, and the voltage fluctuation tends to be given to the piezoelectric actuator 3. Therefore, a possibility arises such that any influence may be exerted on the stable operation. In this wiring structure, the layout is provided for the driver IC 23 and the lines in order to avoid the voltage drop as described above. An explanation will be made below while being focused on this viewpoint.

With reference to FIG. 4 again, the driver IC 23 is mounted on the upper surface side of COF 21. The driver IC 23 is arranged closely to the end edge which serves as the joining portion with respect to FPC 22. The driver IC 23 has a form of IC chip which is rectangular as viewed in a plan view. The driver IC 23 is arranged such that the longitudinal direction thereof is parallel to the extending direction of the end edge. The respective individual lines 24 generally extend toward the end edge disposed on the opposite side from the driver IC 23 arranged as described above.

FPC 22 has a substantially rectangular band-shaped form. The four types of lines, i.e., the power line 25, the ground line 26, the upper constant electric potential line 27, and the lower constant electric potential line 28 extend in parallel to the extending direction of FPC 22 respectively. FPC 22 has a substrate or board which is composed of, for example, polyimide and which is formed and printed with lines of copper or the like on the front surface and the back surface thereof, and a protecting portion which covers the front surface and the back surface of the board with solder resist or the like. The four types of lines 25 to 28 are printed and formed on the front surface of the board, and they are covered with the protecting portion. However, the protecting portion is conveniently omitted from the illustration in FIG. 4A.

Two groups of line groups, each of which is composed of the four types of lines 25 to 28, are provided for FPC 22. The band-shaped FPC 22 has a pair of outer edges which extend in the extending direction thereof. One of the line groups is provided closely to one of the pair of outer edges, and the other line group is provided closely to the other of the pair of outer edges. If the line group is provided at only any one of the outer edges, the voltage is supplied from only one side in relation to the respective longitudinal directions of the piezoelectric actuator 3 and the driver IC 23 to which the respective lines 25 to 28 are connected. The voltage drop arises at the inside with respect to the other sides in the longitudinal directions of the driver IC 23 and the piezoelectric actuator 3. It is feared that any unevenness occurs in relation to the discharge characteristic. On the contrary, in the case of the wiring structure of the present teaching, the two line groups are provided at the outer edges of the wiring board 20. Therefore, the voltage can be supplied from the both sides in the longitudinal directions of the driver IC 23 and the piezoelectric actuator 3. It is possible to stabilize the discharge characteristic without causing the voltage drop. The plurality of unillustrated control signal lines, the power voltage lines (VSS1), and the ground voltage lines (VDD1) extend in parallel to the extending direction of FPC 22 between the respective line groups. The lower constant electric potential line 28, the upper constant electric potential line 27, the ground line 26, and the power line 25 are provided and aligned in this order from the outer edge side to the center side in each of the line groups.

It is necessary that the power line 25 and the ground line 26, which are included in the four types of lines 25 to 28, should be connected to the driver IC 23. Further, it is necessary that the upper constant electric potential line 27 and the lower constant electric potential line 28 should be allowed to extend to the respective connecting terminals with respect to the terminal portions 18, 19 of the piezoelectric actuator 3. These connecting terminals are arranged on the distal side as compared with the driver IC 23 as viewed from the side of FPC 22 on COF 21. Accordingly, in the wiring structure of the present teaching, the set of the upper constant electric potential line 27 and the lower constant electric potential line 28 is arranged on the outer edge side, and the set of the power line 25 and the ground line 26 is arranged on the center side. Therefore, the upper constant electric potential line 27 and the lower constant electric potential line 28, which are provided over the substantially entire portion of the wiring board 20 in the extending direction, can be allowed to pass in the linear form through the area disposed on the outer edge side of the driver IC 23, at the circumferential portion disposed around the mounting position of the driver IC 23. The power line 25 and the ground line 26 are connected to the driver IC 23 without intersecting the upper constant electric potential line 27 and the lower constant electric potential line 28. In this way, the four types of lines 25 to 28 can be arranged in a compact and well-regulated (well-organized) form in the plane on which they are printed and formed.

The lower constant electric potential line 28, which is provided to apply the ground electric potential, is arranged on the outer edge side as compared with the upper constant electric potential line 27 which is provided to apply the high electric potential. The lower constant electric potential line 28 is functionable as the shield line. Therefore, any electrical inconvenience, which is caused by the noise from the outside, hardly occurs. Further, the ground line 26 is arranged on the outer edge side as compared with the power line 25, which is functionable and effective in the same manner as described above.

Figure 4A:
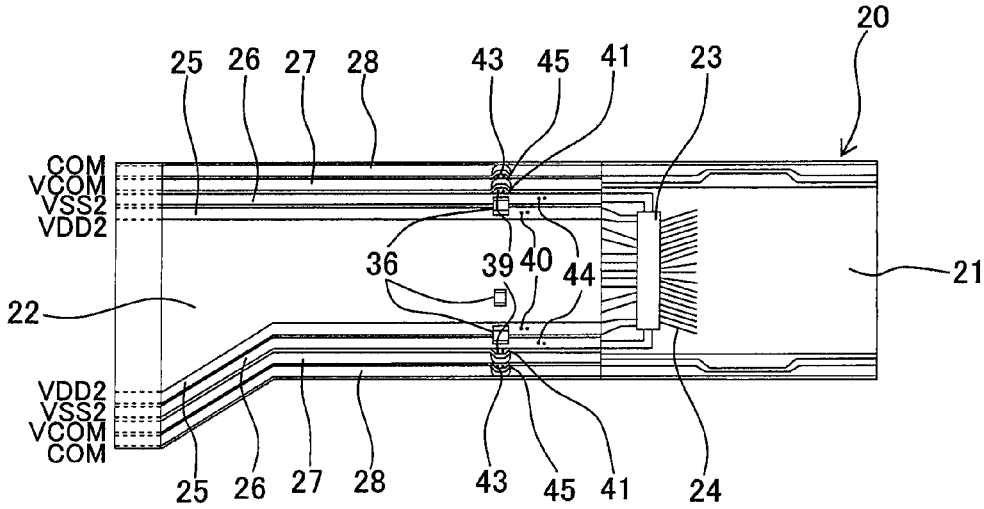
FIG. 4A shows a plan view illustrating a wiring structure applied to the ink discharge head shown in FIG. 1.

A plurality of electronic elements 36, which include, for example, resistors and capacitors, are mounted on the upper surface of FPC 22 in some cases. In such a case, the four types of lines 25 to 28 are appropriately connected by the aid of the electronic elements 36. The electrical function, which is brought about by the electronic elements 36, is not explained in detail herein. However, as shown in FIG. 4A, the electronic elements 36 are provided and aligned substantially on a straight line in the direction perpendicular to the extending direction. That is, the electronic elements 36 are provided at substantially identical positions in relation to the extending direction of FPC 22. When the electronic elements 36 are mounted on FPC 22, it is difficult to freely bend FPC 22 at the mounting positions of the electronic elements 36. Accordingly, the portions, at which FPC 22 is difficult to be freely bent due to the fact that the plurality of electronic elements 36 are arranged at the identical positions in relation to the extending direction of FPC 22, are decreased as far as possible so that the easy handling performance and the bendability of FPC 22 are not deteriorated as far as possible.

The first short circuit line 29 and the second short circuit line 30 are provided for each of the two line groups composed of the four types of lines 25 to 28 described above. The first short circuit line 29 connects the power line 25 and the upper constant electric potential line 27. Therefore, the first short circuit line 29 is arranged not to interfere with the ground line 26 allowed to intervene between the lines 25, 27. The second short circuit line 30 connects the ground line 26 and the lower constant electric potential line 28. Therefore, the second short circuit line 30 is arranged not to interfere with the upper constant electric potential line 27 allowed to intervene between the lines 26, 28. On the other hand, as described above, the four types of lines 25 to 28 are arranged in the compact and well-organized manner on the front surface of the board of FPC 22.

Figure 4B:
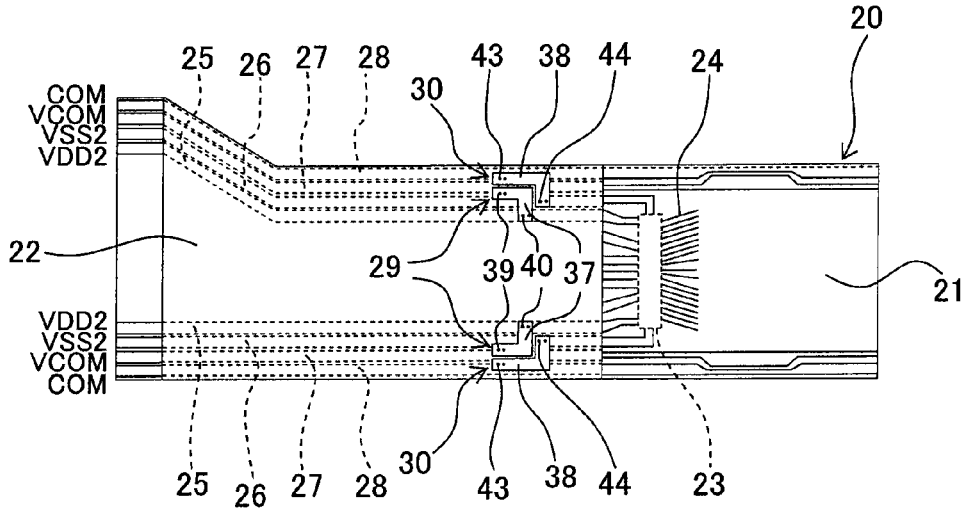
FIG. 4B shows a back view thereof.

The first and second short circuit lines 29, 30 are realized by providing jumper lines 37, 38 on the back surface of the board respectively. In this embodiment, FPC 22 is a so-called double-sided flexible printed circuit board. The jumper lines 37, 38 are printed and formed on the back surface of the board of FPC 22, and they are covered with the protecting portion. In FIG. 4B, the protecting portion is conveniently omitted from the illustration. In place of the jumper lines 37, 38, for example, any versatile or general purpose jumper cable may be used, or any jumper chip may be used. Accordingly, even when the double-sided flexible printed circuit board is not used, it is possible to use a single-sided flexible printed circuit board in which the lines are provided only on the front surface. However, when the lines, which are to be short-circuited, are formed at a high density, the connection with the jumper cable causes such a problem that the operation is difficult to be performed in the connecting step, and the production is hardly performed. When the jumper chip is provided, the rated current of the chip is exceeded, because the large discharge current flows through the jumper line. A problem arises such that the chip tends to be destroyed. However, when the jumper lines are provided in accordance with the structure of this embodiment, it is possible to avoid the problems as described above. Further, it is possible to avoid any bridged structure in which the first and second short circuit lines 29, 30 extend over the ground line 26 or the upper constant electric potential line 27 on the front surface of the board. It is possible to avoid any large size of this wiring structure in the thickness direction of the wiring board 20.

Through-holes 39, 40, which penetrate through one end and the other end of the jumper line 37 for constructing the first short circuit line 29 respectively, are formed through the board of FPC 22. The through-holes 39, which are provided at one end, are open in the island-shaped land portion 41 having the conductivity and formed to partially cut out the band-shaped upper constant electric potential line 27 on the front surface side of the board. The land portion 41 is provided at the position aligned on a straight line with respect to the electronic element 36 described above in the direction perpendicular to the extending direction of FPC 22. The through-holes 40, which are provided at the other end, are open at the central portion in the widthwise direction of the band-shaped power line 26 on the front surface side of the board. The through-holes 40 are arranged on the proximal side of the driver IC 23 as viewed from the land portion 41 and the electronic element 36.

The respective through-holes 39, 40 are filled with a conductive material. Accordingly, the jumper line 37 and the land portion 41 are in electrical conduction, and the jumper line 37 and the power line 25 are in electrical conduction. However, at this stage, the land portion 41 and the upper constant electric potential line 27 are not in conduction with each other, because any conductive material such as solder or the like (not shown) is not installed as described later on. In other words, the first short circuit line 29 is not constructed completely in this state. The conduction between the land portion 41 and the upper constant electric potential line 27 is performed after the polarization step for the piezoelectric actuator 3.

Specifically, the piezoelectric actuator 3, which is in the non-polarized state, is stacked and joined to the channel unit 2, and the piezoelectric actuator 3 is further joined to COF 21. In this situation, COF 21 and FPC 22 are not joined to one another. After that, FPC 22 is joined to COF 21, and the polarization step is performed for the piezoelectric actuator 3.

In the polarization step, the assembly obtained as described above is placed in an atmosphere at 100° C., and the end portion of FPC 22 is connected to a polarizing apparatus. The high electric potential difference is generated between the respective electrodes 11 to 13 of the piezoelectric actuator 3 via the individual lines 24, the upper constant electric potential lines 27, and the lower constant electric potential lines 28. Accordingly, the first and second active portions 14, 15 are polarized.

Figure 6A:
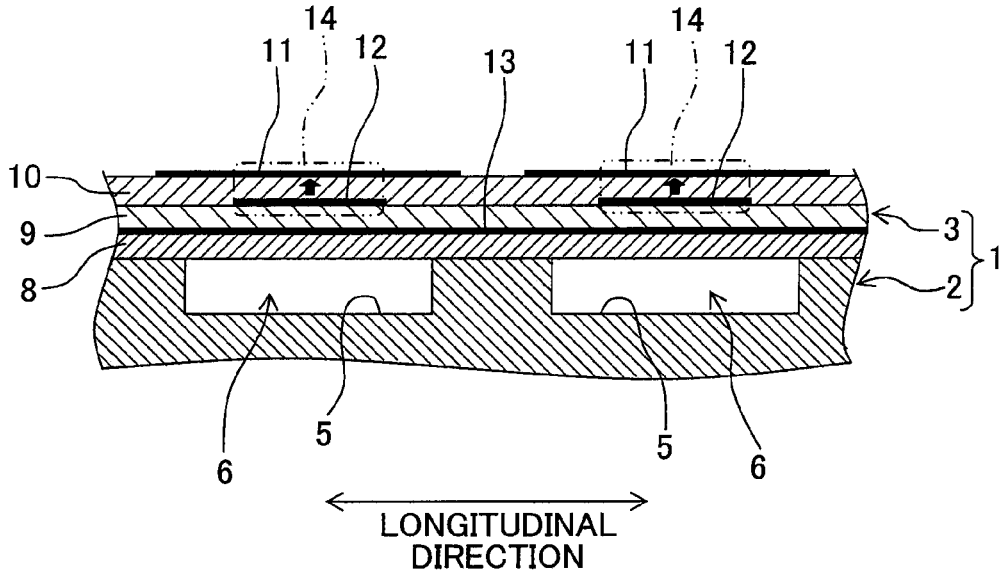
FIGS. 6A and 6B illustrate the polarization steps during the production of the piezoelectric actuator shown in FIGS. 1 to 3.
Figure 6B:
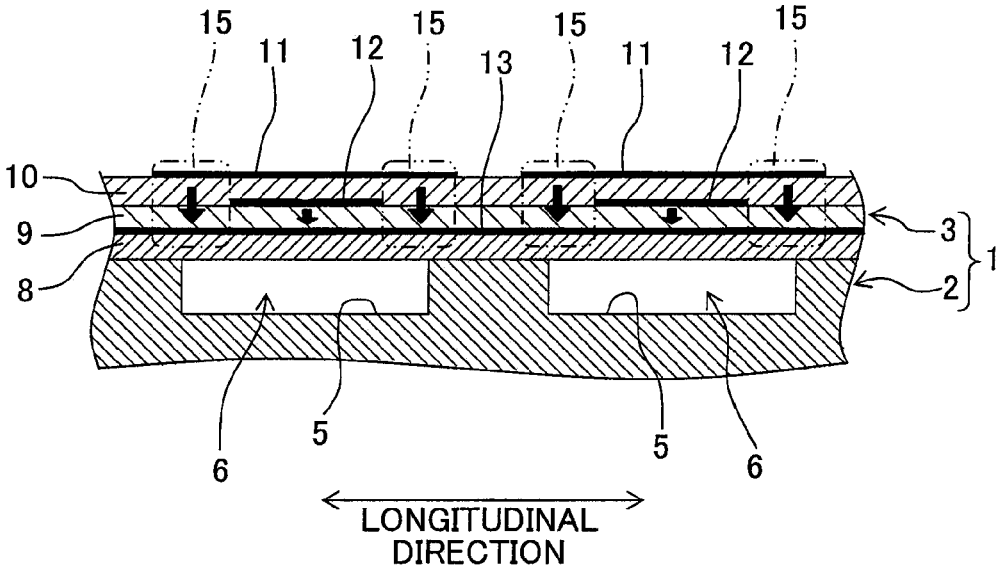

For example, with reference to FIG. 6A, an electric potential of 36 V is applied to the upper constant electric potential electrode 12, and an electric potential of 0 V is applied to the individual electrode 11. Accordingly, the high voltage is applied to the first active portion 14, and the first active portion 14 is polarized in the upward direction. With reference to FIG. 6B, an electric potential of 28 V is applied to the upper constant electric potential electrode 12, an electric potential of −60 V is applied to the lower constant electric potential electrode 13, and an electric potential of 28 V is applied to the individual electrode 11. Accordingly, the second active portions 15 and the portion interposed between the first and second constant electric potential electrodes 12, 13 are polarized in the downward direction.

After that, FPC 22 is detached from the polarizing apparatus. Further, the conductive material (not shown) such as the solder or the like is installed to extend over the land portion 41 and the upper constant electric potential line 27 on the front surface of the board of FPC 22. The land portion 41 is in electrical conduction with the upper constant electric potential line 23 via the conductive material. In this way, the upper constant electric potential line 27 is in electrical conduction with the power line 25 via the first short circuit line 29 composed of the conductive material, the land portion 41, the through-holes 39, the jumper line 37, and the through-holes 40.

The second short circuit line 30 is produced by performing the steps which are the same as or equivalent to the above, and the second short circuit line 30 is constructed in the same manner as described above. In other words, through-holes 43, 44, which penetrate through the respective end portions of the jumper line 38 for constructing the second short circuit line 30, are formed through the board of FPC 22. First through-holes 43 are open in a land portion 45 formed to partially cut out the lower constant electric potential line 28 on the front surface side of the board. Second through-holes 44 are open at a central portion in the widthwise direction of the ground line 27. The land portion 45 is arranged to be aligned on a straight line with respect to the electronic element 36. The second through-holes 44 are arranged on the proximal side of the driver IC 23 as viewed from the land portion 45 and the electronic element 36. The respective through-holes 43, 44 are filled with the conductive material. The conductive material such as the solder or the like (not shown) is installed to extend over the land portion 45 and the lower constant electric potential line 28 after the polarization step for the piezoelectric actuator. In this way, the lower constant electric potential line 28 is in electrical conduction with the ground line 27 via the second short circuit line 30 composed of the conductive material, the land portion 45, the through-holes 43, the jumper line 38, and the through-holes 44.

As described above, the first and second short circuit lines 29, 30 are not constructed completely when the polarization step is performed. The reason thereof is as follows. If the polarization step is performed in a state in which the first and second short circuit lines are constructed completely, for example, in the case of the situation shown in FIG. 6A, the power line 25 and the upper constant electric potential line 27 are at the same electric potential. In this situation, the high electric potential of 36 V is applied to the driver IC 23 via the power line 25. As described above, as for the driver IC 23, the voltage value, which is principally brought about by the power voltage of the driver IC 23 itself (for example, 3.3 V) and the power voltage for the driving (for example, 28 V), is defined as the maximum rated voltage. Therefore, if the polarization step is performed in the state in which the first short circuit line 29 is constructed, the high voltage (for example, 36 V), which exceeds the maximum rated voltage, is applied to the driver IC 23 to cause the destruction of the driver IC 23. Similarly, in the case of the situation shown in FIG. 6B, the ground line 26 and the lower constant electric potential line 28 are at the same electric potential. Therefore, the high voltage of 60 V is applied to the driver IC 23 via the ground line 26 to cause the destruction of the driver IC 23. Therefore, when the wiring structure of the present teaching is prepared, the first and second short circuit lines 29, 30 are constructed after the completion of the polarization step for the piezoelectric actuator 3.

As described above, in the wiring structure of the present teaching, the first and second short circuit lines 29, 30 can be easily constructed by installing the conductive material on the front surface of the board after the polarization step for the piezoelectric actuator. The conductive material is installed on the front surface of the board when the first and second short circuit lines 29, 30 are constructed. The positions of the installation of the conductive material are approximately the same as the positions of the mounting of the electronic elements 36 in relation to the extending direction of FPC 22. In other words, the first and second short circuit lines 29, 30 are constructed so that the portions, at which FPC 22 is difficult to be freely bent, are decreased as far as possible in cooperation with the electronic elements 36. Accordingly, the easy handling performance and the bendability of FPC 22 are not deteriorated as far as possible.

When the contacts of the first and second short circuit lines 29, 30 disposed on one side (i.e., those substantially equivalent to the positions of the through-holes 39, 43) are arranged on the basis of the relationship with respect to the mounting positions of the other electronic elements 36, it is necessary that the contacts disposed on the other side (i.e., those substantially equivalent to the positions of the through-holes 40, 44) should be displaced in relation to the extending direction of FPC 22 in order to avoid any interference with the electronic elements 36 as well. In the wiring structure of the present teaching, the contacts disposed on the other side are positioned on the side of the driver IC 23 as viewed from the positions of the contacts disposed on one side which are the mounting portions of the electronic elements 36 as well. Further, the first and second short circuit lines 29, 30 themselves are provided closely to the end edge joined to COF 21 on FPC 22.

Therefore, the line lengths, which range from the first and second active portions 14, 15 to the first and second short circuit lines 29, 30, can be decreased as shortly as possible. The voltage drop of the voltage inputted into the driver IC 23 can be decreased as small as possible. It is possible to avoid the destruction of the driver IC 23. Further, the voltage fluctuation, which arises in the active portions 14, 15, can be decreased as small as possible. However, in order to further shorten the line lengths, the first and second short circuit lines 29, 30 may be provided on COF 21. The shape of the jumper line 37, 38 is not limited to the L-shaped form exemplified in FIG. 4B by way of example. Any shape is available provided that the construction as described above can be realized and the arrangement can be made without causing any interference with each other.

The embodiment of the present invention has been explained above. However, the foregoing construction or arrangement can be appropriately changed within the scope of the present invention. For example, the "first electric potential" is the high electric potential, and the "second electric potential" is the ground electric potential. However, even when this relationship is reversed, it is possible to operate the piezoelectric actuator 3 in the same manner as described above. In this case, the first short circuit line may be a line to short-circuit the power line and the lower constant electric potential line disposed on the side on which the high electric potential is applied. The second short circuit line may be a line to short-circuit the ground line and the upper constant electric potential line disposed on the side on which the ground electric potential is applied.

It is preferable for COF 21 that the lower constant electric potential line 28, the upper constant electric potential line 27, the ground line 26, and the power line 25 are aligned from the outside in this order from the outer side in each of the line groups. However, the order or sequence of the two lines connected to the piezoelectric actuator 3 and the order or sequence of the two lines connected to the driver IC 23 can be exchanged respectively. In other words, the order or sequence of the lines is not limited to the order or sequence shown in FIG. 4 provided that the two lines of the lower constant electric potential line 28 and the upper constant electric potential line 27 connected to the piezoelectric actuator 3 form the two outer lines of the four lines, and the two lines of the ground line 26 and the power line 25 connected to the driver IC 23 form the two inner lines of the four lines. For example, the lines may be aligned in an order or sequence of the upper constant electric potential line, the lower constant electric potential line, the ground line, and the power line from the outside. Alternatively, the lines may be aligned in an order or sequence of the lower constant electric potential line, the upper constant electric potential line, the power line, and the ground line. In this case, the lengths and the shapes of the jumper lines are appropriately changed for the first and second short circuit lines 29, 30.

First Modified Embodiment

In the embodiment described above, the single driver is mounted on COF 21, and single FPC, which is provided with the power line and the ground line corresponding to the driver, is joined to COF. However, the wiring structure according to the present teaching is not limited to the so-called single-sided lead system as described above. As described in this modified embodiment, it is also possible to preferably apply the present invention to a wiring structure of the so-called double-sided lead system wherein two drivers are mounted on COF, and two FPC's, which are provided with power lines and ground lines corresponding to the drivers respectively, are joined to the respective end edges of COF. In the explanation of the wiring structure according to this modified embodiment, any description, which is overlapped with the description of the wiring structure according to the embodiment described above, is appropriately omitted.

Figure 7A:
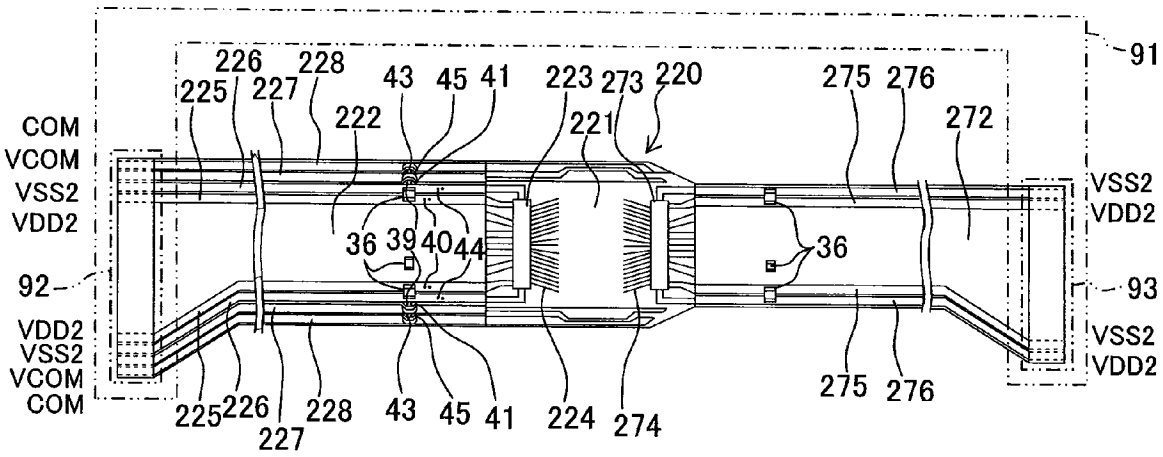
FIG. 7A shows a plan view illustrating a wiring structure applied to an ink discharge head according to a first modified embodiment.
Figure 7B:
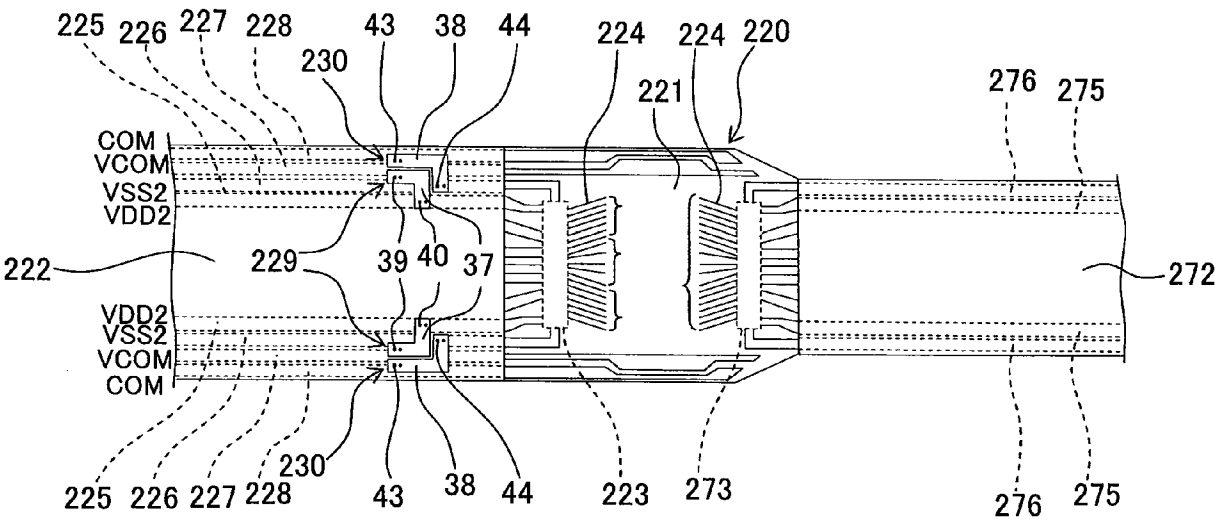
FIG. 7B shows a back view thereof.

As shown in FIGS. 7A and 7B, a wiring board 220 according to this modified embodiment includes rectangular COF 221 which is overlapped with the piezoelectric actuator 3 from the upper side and which is joined to the upper portion of the piezoelectric actuator 3, band-shaped first FPC 222 which is joined to one end edge of COF 221, and band-shaped second FPC 272 which is joined to the other end edge of COF 221.

First FPC 222 is provided so that first FPC 222 is led in one direction from the piezoelectric actuator 3 to the outside in a state in which COF 221 is joined to the piezoelectric actuator 3. Second FPC 272 is provided so that second FPC 272 is led in the direction opposite to the direction of first FPC 222 from the piezoelectric actuator 3 to the outside.

Any one of COF 221 and FPC's 222, 272 is a known flexible circuit board. Respective FPC's 222, 272 are joined to the end edges of COF 221, for example, by means of the soldering. As a result of the joining, the lines provided for COF 221 and the lines provided for FPC's 222, 272 are in electrical conduction with each other. Contacts of the respective lines are provided at the end edges disposed on the side opposite to the joining portions of respective FPC's 222, 272 with respect to COF 221. The contacts may be connected to receptacle connectors 92, 93 mounted on the board 91 arranged at predetermined positions in the ink-jet printer.

Two drivers 223, 273, each of which selectively outputs the voltage to be applied to each of the individual electrodes 11, are mounted on COF 221 of the wiring board 220. The first driver 223, which is arranged on the left side in the drawing, is provided corresponding to the lines provided for first FPC 222. The second driver 273, which is arranged on the right side in the drawing, is provided corresponding to the lines provided for second FPC 272. The wiring board 220 is provided with a plurality of individual lines 224, 274, power lines (VDD2) 225, 275, ground lines (VSS2) 226, 276, upper constant electric potential lines (VCOM) 227, lower constant electric potential lines (COM) 228, first short circuit lines 229, and second short circuit lines 230. The wiring board 220 is also provided with, for example, the unillustrated waveform signal line, the printing data line, the control signal line, the power voltage line, and the ground voltage line, in the same manner as the wiring board 20. The lines are connected to the drivers 223, 273.

The respective individual lines 224, 274 are provided corresponding to the respective individual electrodes 11, which are the lines to apply the first and second electric potentials to the respective individual electrodes 11 in accordance with the ink discharge timing. The respective individual lines 224, 274 extend from the corresponding drivers 223, 273 toward the connecting terminals on the wiring board 220 corresponding to the terminal portions 17 of the respective individual electrodes 11.

The power lines (VDD2) 225, 275 are the lines to supply the electrical power to the corresponding drivers 223, 273, which are connected to the drivers 223, 273. The ground lines (VSS2) 226, 276 are the lines to connect the corresponding drivers 223, 273 to the ground electric potential, which are connected to the drivers 223, 273.

The upper constant electric potential lines (VCOM) 227 are the lines to always apply the first electric potential as the high electric potential to the upper constant electric potential electrodes 12, which extend toward the connecting terminals on the wiring board 220 corresponding to the terminal portions 18 of the upper constant electric potential electrodes 12. The lower constant electric potential lines (COM) 228 are the lines to always apply the second electric potential as the ground electric potential to the lower constant electric potential electrodes 13, which extend toward the connecting terminals on the wiring board 220 corresponding to the terminal portions 19 of the lower constant electric potential electrodes 13.

In this modified embodiment, the upper constant electric potential lines 227 and the lower constant electric potential lines 228 are provided for only first FPC 222, and they are not provided for second FPC 272. The first short circuit lines 229 are the lines to connect the power lines 225 and the upper constant electric potential lines 227. The second short circuit lines 230 are the lines to connect the ground lines 226 and the lower constant electric potential lines 228. The first and second short circuit lines 229, 230 are also provided for only first FPC 222.

As described above, in this wiring structure, the lines 226, 227, which are directed to the piezoelectric actuator 3, are provided for only FPC disposed on one side (i.e., first FPC 222) in the wiring structure based on the double-sided lead system. The short circuit lines, which are formed to short-circuit the lines 227, 228 and the lines 225, 226 disposed on the side of the driver 223, are provided for only FPC 222. The lines as described above are not provided for the other FPC (i.e., second FPC 272). Therefore, it is unnecessary to print and form the lines on the back surface side of the board portion, and it is possible to lower the production cost of FPC, which contributes to the decreased in cost of the entire wiring structure.

Second Modified Embodiment

Figure 8A:
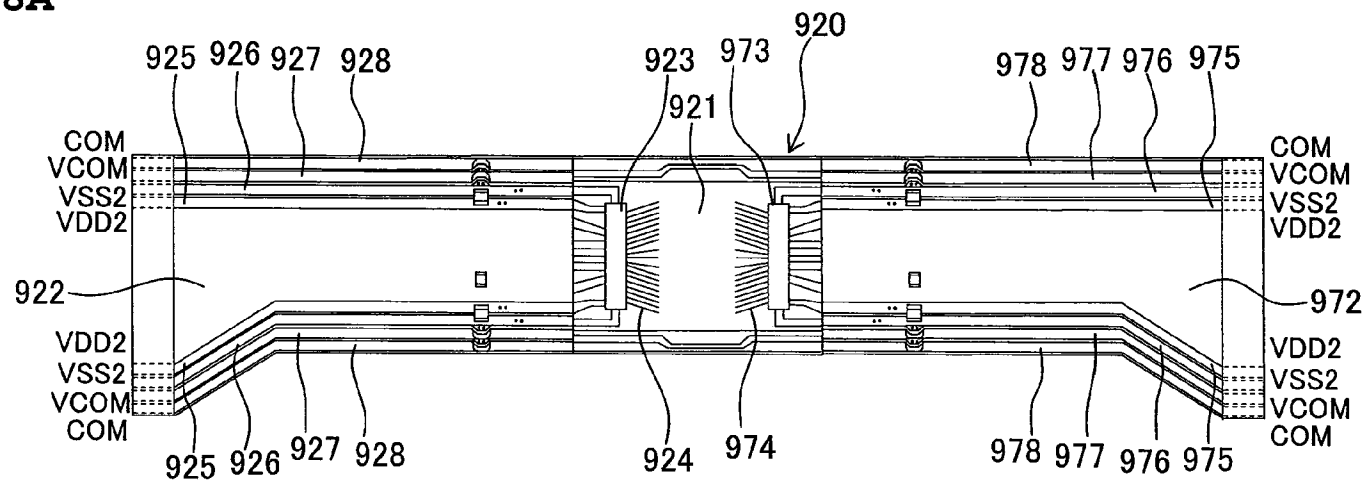
FIG. 8A shows a plan view illustrating a wiring structure applied to an ink discharge head according to a second modified embodiment.
Figure 8B:
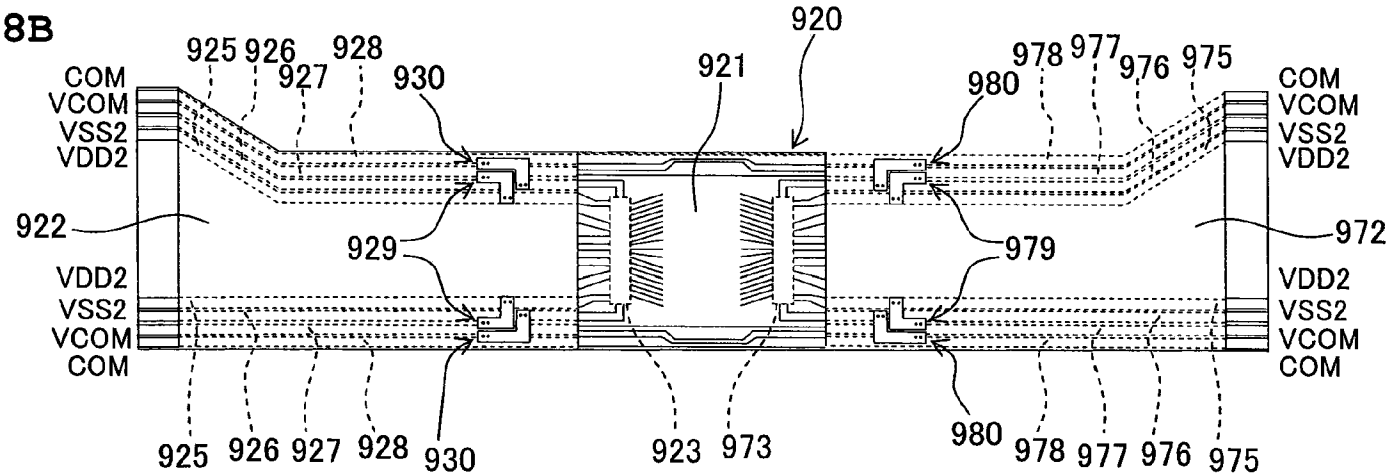
FIG. 8B shows a back view thereof.

In a wiring board 920 having a wiring structure according to a second modified embodiment shown in FIG. 8, first and second drivers 923, 973 are mounted on COF 921. Two FPC's 922, 972, which are provided with the lines corresponding to the respective drivers, are joined to COF 921. Respective FPC's 922, 972 are constructed identically with each other. That is, any one of FPC's 922, 972 is provided with power lines 925, 975 and ground lines 926, 927 which are connected to the corresponding drivers 923, 973, upper constant electric potential lines 927, 977 and lower constant electric potential lines 928, 978 which are formed to apply the predetermined electric potential to the piezoelectric actuator 3, first short circuit lines 929, 979 which are formed to short-circuit the power lines 925, 975 and the upper constant electric potential lines 927, 977, and second short circuit lines 930, 980 which are formed to short-circuit the ground lines 926, 976 and the lower constant electric potential lines 928, 978.

In any one of FPC's 922, 972, the first and second short circuit lines 929, 930 are constructed by utilizing jumper lines provided on the back surface side of the board portion. In this way, the wiring structure may be constructed so that both FPC's 922, 972 are provided with the lines on the both front and back surfaces in the wiring structure based on the so-called double-sided lead system in which two FPC's 922, 972 are led in the mutually opposite directions from single COF 921.

The liquid droplet discharge head according to the present teaching is not limited to the ink discharge head carried on the ink-jet printer. The liquid droplet discharge head is also preferably applicable to the liquid droplet discharge head carried on the apparatus for producing the color filter of the liquid crystal display device by discharging any liquid other than the ink including, for example, a coloring liquid, and the liquid discharge apparatus to be used, for example, for the apparatus for forming the electrical lines by discharging a conductive liquid. In the present teaching, the term "on" includes the both meanings of "directly on" and "indirectly on". For example, with reference to FIG. 2, the lower constant electric potential electrode 13 is arranged directly on the bottom layer 8. However, the present teaching is not limited thereto. For example, a thin insulating film may intervene between the bottom layer 8 and the lower constant electric potential electrode 13. With reference to FIGS. 7 and 8, two FPC's are led in the mutually opposite directions. However, the present teaching is not limited thereto. Two FPC's may be led in arbitrary directions.

According to the present teaching, it is possible to provide the liquid droplet discharge apparatus having the liquid droplet discharge head which is capable of satisfactorily suppressing the crosstalk even when the pressure chambers are highly densified. In the liquid droplet discharge apparatus according to the present teaching, the two types of active portions, which are formed by the three types of electrodes, can be operated stably respectively in order to suppress the crosstalk. Therefore, it is advantageous to apply the liquid droplet discharge apparatus according to the present teaching to the ink-jet printer in which the image is recorded on the medium by landing the inks on the medium such as paper.

What is claimed is:

1. A liquid droplet discharge head which discharges liquid droplets of a liquid onto a medium, the liquid droplet discharge head comprising:

a channel unit which is formed with a plurality of pressure chambers and a plurality of nozzles communicated with the pressure chambers, respectively;

a piezoelectric actuator which is arranged on the channel unit to cover the pressure chambers and which selectively applies a pressure to the liquid in the pressure chambers to discharge the liquid therefrom, the piezoelectric actuator including:

a piezoelectric layer which has first active portions corresponding to central portions of the pressure chambers and second active portions corresponding to portions surrounding the central portions of the pressure chambers;

a first constant electric potential electrode which is arranged on the first active portions;

a second constant electric potential electrode which is arranged on the second active portions; and individual electrodes which are arranged to face the first and second constant electric potential electrodes, the first active portions being arranged between the individual electrodes and the first constant electric potential electrodes, and the second active portions being arranged between the individual electrodes and the second constant electric potential electrodes; and a wiring structure which is connected to the piezoelectric actuator, the wiring structure including:

a wiring board;

a driver IC which is provided on the wiring board and which applies a driving electric potential to the individual electrodes; and lines which are provided on the wiring board, the lines including individual lines through each of which the driving electric potential from the driver IC is supplied to one of the individual electrodes, a power line through which an electric power is supplied to the driver IC, a ground line through which a ground electric potential is supplied to the driver IC, a first constant electric potential line through which a first constant electric potential is applied to the first constant electric potential electrode, a second constant electric potential line through which a second constant electric potential is applied to the second constant electric potential electrode, a first short circuit portion which short-circuits the power line and the first constant electric potential line, and a second short circuit portion which short-circuits the ground line and the second constant electric potential line, wherein the first and second active portions are deformed respectively so that the first and second active portions are elongated in a first direction directed toward the pressure chamber and the first and second active portions are shrunk in a second direction perpendicular to the first direction under a condition that the driving electric potential is applied to the individual electrodes; an electric field is not generated in the second active portion under a condition that an electric field is generated in the first active portion, and an electric field is not generated in the first active portion under a condition that an electric field is generated in the second active portion.

2. The liquid droplet discharge head according to claim 1, wherein each of the first active portions is polarized in a direction directed from the first constant electric potential electrode to one of the individual electrodes, and each of the second active portions is polarized in a direction directed from one of the individual electrodes to the second constant electric potential electrode.

3. The liquid droplet discharge head according to claim 1, wherein the first short circuit portion and the second short circuit portion are provided in the vicinity of the driver IC.

4. The liquid droplet discharge head according to claim 3, wherein the wiring board includes a first wiring board which is joined to the piezoelectric actuator, and a second wiring board having a joining portion which is joined to an end edge of the first wiring board; and the driver IC is mounted at a position close to the end edge of the first wiring board, one of the first short circuit portion and the second short circuit portion being provided at a position close to the joining portion of the second wiring board.

5. The liquid droplet discharge head according to claim 1, wherein the wiring board extends in a predetermined extending direction from the actuator, the driver IC has an elongated shape which is elongated in a predetermined longitudinal direction, the driver IC being provided on the wiring board so that the longitudinal direction is substantially perpendicular to the extending direction; and the power line, the ground line, the first constant electric potential line, and the second constant electric potential line are aligned in the longitudinal direction.

6. The liquid droplet discharge head according to claim 5, wherein a set of lines including the first constant electric potential line and the second constant electric potential line and another set of lines including the ground line and the power line are aligned successively in an order from an outer edge side of the wiring board; and the first constant electric potential line and the second constant electric potential line extend linearly in the extending direction and at outside the longitudinal direction of the driver IC.

7. The liquid droplet discharge head according to claim 6, wherein the second constant electric potential is a ground electric potential, the second constant electric potential line is provided outside the first constant electric potential line; and the first short circuit portion has a jumper line which is provided to stride over the second constant electric potential line, and the second short circuit portion has a jumper line which is provided to stride over the ground line.

8. The liquid droplet discharge head according to claim 7, wherein the wiring board has a front surface on which the first and second constant electric potential lines, the ground line, and the power line are provided, and a back surface which is disposed on a side opposite to the front surface;

the jumper line of the first short circuit portion is provided to stride over an area of the back surface corresponding to a portion at which the power line is provided and an area corresponding to a portion at which the first constant electric potential line is provided; and the jumper line of the second short circuit portion is provided to stride over an area of the back surface corresponding to a portion at which the ground line is provided and an area corresponding to a portion at which the second constant electric potential line is provided.

9. The liquid droplet discharge head according to claim 8, wherein each of the jumper lines of the first and second short circuit portions has a substantially L-shaped form, and includes:

a first portion which intersects the power line or the ground line to stride over the power line or the ground line; and a second portion which extends from the first portion toward a side opposite to the driver IC so that the second portion is substantially perpendicular to the first portion.

10. The liquid droplet discharge head according to claim 9, wherein a conductive member which electrically connects the second portion and the first constant electric potential line or another conductive member which electrically connects the second portion and the second constant electric potential line, is arranged in an area of the front surface of the wiring board the area overlapping with an end of the second portion.

11. The liquid droplet discharge head according to claim 10, wherein a through-hole is formed in an area of the wiring board overlapped with an end of the first portion; and the first portion and the power line, or the first portion and the ground line are electrically connected to each other by a conductive material filled in the through-hole.

12. The liquid droplet discharge head according to claim 5, wherein the wiring structure further includes a plurality of electronic elements, and the electronic elements and the first and second short circuit portions are provided on the wiring board so that the electronic elements and the first and second short circuit portions are aligned in a direction substantially perpendicular to the extending direction.

13. The liquid droplet discharge head according to claim 1, wherein the driver IC includes two driver IC's;

the wiring board includes a first wiring board which is joined to the piezoelectric actuator and two second wiring boards which are joined to two end edges of the first wiring board respectively; and the two driver IC's are provided at positions close to the two end edges of the first wiring board respectively, the first and second short circuit portions being arranged on at least one of the two second wiring boards.

14. The liquid droplet discharge head according to claim 13, wherein the two second wiring boards extend in mutually opposite directions.

15. An ink-jet printer which discharges the ink as the liquid to the medium, the ink-jet printer comprising:

the liquid droplet discharge head as defined in claim 1;

an ink tank which supplies the ink to the liquid droplet discharge head; and a transport mechanism which transports the medium to an area facing the liquid droplet discharge head.

16. A method for producing the liquid droplet discharge head as defined in claim 1, the method comprising:

polarizing the first active portion of the piezoelectric layer by applying a first voltage between the first constant electric potential electrode and each of the individual electrodes while the first constant electric potential electrode and the power line are electrically insulated;

polarizing the second active portion of the piezoelectric layer by applying a second voltage between the second constant electric potential electrode and each of the individual electrodes while the second constant electric potential electrode and the ground line are electrically insulated; and providing the first and second short circuit portions after polarizing the first and second active portions of the piezoelectric layer.

* * * * *